US005666109A

United States Patent [19]

Fukui et al.

[11] Patent Number: 5,666,109

[45] Date of Patent: Sep. 9, 1997

[54] VEHICLE TO ROADSIDE COMMUNICATION SYSTEM FOR DETERMINING EQUIPMENT PROBLEMS

[75] Inventors: Mitsuhiro Fukui, Nagoya; Fuminari Ishihara, Susono, both of Japan

[73] Assignee: Toyota Jidosha Kabushiki Kaisha, Toyota, Japan

[21] Appl. No.: 452,787

[22] Filed: May 30, 1995

[30] Foreign Application Priority Data

Jul. 11, 1994 [JP] Japan ..... 6-158772

[51] Int. Cl.[6] ..... G08G 1/09

[52] U.S. Cl. ..... 340/905; 340/928; 235/384; 455/67.7; 455/521

[58] Field of Search ..... 340/905, 928; 235/384; 364/436; 455/54.1, 67.1, 67.7

[56] References Cited

U.S. PATENT DOCUMENTS

| | | | |
|---|---|---|---|
| 4,466,125 | 8/1984 | Kanayama | 455/56 |
| 5,245,346 | 9/1993 | Nishimura et al. | 342/42 |
| 5,289,183 | 2/1994 | Hassett et al. | 340/905 |
| 5,424,727 | 6/1995 | Shieh | 340/928 |
| 5,485,520 | 1/1996 | Chaum et al. | 342/42 |
| 5,537,672 | 7/1996 | Grabow et al. | 455/54.1 |

FOREIGN PATENT DOCUMENTS

| | | |
|---|---|---|
| 0 567 889 | 11/1993 | European Pat. Off. . |
| 64-72629 | 3/1989 | Japan . |
| 4-24200 | 2/1992 | Japan . |

OTHER PUBLICATIONS

Patent Abstracts of Japan, vol. 16, No. 517, 23 Oct. 1992 & JP–A–04 192626 (Fujitsu Ten Ltd) 10 Jul. 1992.

*Primary Examiner*—Jeffery Hofsass
*Assistant Examiner*—Daniel J. Wu
*Attorney, Agent, or Firm*—Kenyon & Kenyon

[57] ABSTRACT

On the side of a vehicle, when the CRC error check of received data is performed (S19) and an error occurs plural times (S21, S22), it can be determined that an on-vehicle down link is defective (S23). Furthermore, the results of the CRC error check are stored, and at the time of an up link communication (S14), the results are sent to another road side equipment. Thus, in the road side equipment, a down link error of the other road side equipment can be detected on the basis of the sent information. Moreover, information as to whether or not a signal regarding a link which the car has passed is received from a beacon (S23) is stored, and this is sent in the up link communication (S14), whereby an abnormal road side equipment can be detected on the basis of the sequence of this link. In addition, an up link problem on the side of the car can be detected from the fact that specific information cannot be received (S26).

12 Claims, 10 Drawing Sheets

CLASSIFICATION OF TROUBLE AND DEFECT
(BOTH ROAD SIDE AND CAR SIDE)

| CASE | 1 | 2 | 3 | 4 | 5 | 6 | 7 | 8 | 9 |
|---|---|---|---|---|---|---|---|---|---|
| UP LINK | ○ | ○ | ○ | △ | △ | △ | × | × | × |
| DOWN LINK | ○ | △ | × | ○ | △ | × | ○ | △ | × |

○ : NORMAL STATE

△ : COMMUNICATION IS POSSIBLE TO SOME EXTENT BUT AN ERROR IS PARTIALLY GENERATED IN A PART OF INFORMATION BY SOILS OR THE LIKE (RESTORATION BY CLEANING OR THE LIKE)

× : QUITE ABNORMAL STATE FOR WHICH REPAIR IS NECESSARY.

Fig. 5

DATA STRING IMAGE ON MEMORY

| LINK NO. | RECEIVING FLAG | BEACON NO. |
|---|---|---|
| ×××× | 1 | △△△ |
| • | 1 | • |
| • | • | • |
| • | 0 | • |

Fig. 8

VEHICLE TO ROADSIDE COMMUNICATION SYSTEM FOR DETERMINING EQUIPMENT PROBLEMS

BACKGROUND OF THE INVENTION (i) Field of the Invention

The present invention relates to a vehicle to roadside communication by the use of a plurality of road side equipments and on-vehicle equipments carried on a plurality of vehicles.

(ii) Description of the Related Art

Heretofore, it has been suggested that communication equipments (road side equipments) are arranged on a road, and vehicle to roadside communication is carried out between the road side equipments and a communication equipment carried on a vehicle (an on-vehicle equipment) to perform interchange of information. For example, if a vehicle receives position information, the information of the present position of the vehicle can be revised in a navigation device or the like. Furthermore, if the vehicle receives accident information and congestion information from the road side equipments, these information items can be utilized to select a route and the like. Moreover, if the information of the destination of the vehicle is sent from the on-vehicle equipment to the road side equipment, the vehicle can obtain information about an optimum route to be selected. On the other hand, the road side equipments can ascertain the number of passed vehicles as a result of the communication with the vehicles, and if the road side equipments receive the information of the ID numbers or the like of the vehicles, a time required for the car to pass between the road side equipments can be recognized. In addition, if the road side equipments receive the destination information from the vehicles, the number of vehicles which will pass a certain district in the future can be predicted. Therefore, if many road side equipments are collectively supervised, the traffic situation in the district can be correctly ascertained, and thus a proper traffic restriction, the supervision of signals and the supply of optimum route information can be accomplished.

The above-mentioned vehicle to roadside communication system can be classified into a system by radio and a system using rays such as infrared rays. Radio is a system which has been widely used as a communication means, and it can be considered that radio is easily applicable to the vehicle to roadside communication. On the other hand, in the system using rays such as infrared rays, devices for sending and receiving signals are inexpensive, and since they have a high directivity, the system possesses a merit that interference can be prevented. For these reasons, the system using rays has also been investigated together with the system using radio, so as to put them to practical use. In this connection, the vehicle to roadside communication using rays has been disclosed in Japanese Utility Model Laid-open Publication No. Hei 4-24200.

In such a communication, the generation of errors is an unavoidable problem, and a measure against the errors is necessary. Particularly in the vehicle to roadside communication in which two-way communication is performed, it is difficult to specify whether a cause of the error resides in the road side equipment or the on-vehicle equipment. Therefore, the equipment causing the communication error cannot be specified, and so there is a problem that it is difficult to promptly carry out proper maintenance or error processing for such an equipment.

SUMMARY OF THE INVENTION

The present invention has been conceived in view of the above-mentioned problems, and an object of the present invention is to provide a vehicle to roadside communication system which can ascertain whether a cause of error generation resides in a road side equipment or an on-vehicle equipment.

According to the present invention, when down link communication is performed from the road side equipment to the on-vehicle equipment, a problem is determined on the basis of the content of this down link communication. In the event that a problem is detected, the information regarding this fact is reported to another road side equipment. The problem of a down link system in the road side equipment cannot be determined in this road side equipment. However, according to the system of the present invention, the information that the road side equipment is abnormal is sent to another road side equipment, and in the event that the information indicating that the specific road side equipment is out of order is sent a number of times to the other road side equipment, it can be presumed that the down link problem is present in the specific road side equipment, whereby the down link problem in the road side equipment can be detected.

Furthermore, when a problem is detected in the down link communication from a plurality of road side equipments by a down link problem detecting section, it can be determined that the problem is present in the down link system in the on-vehicle equipment. This is based on the logic that the problem cannot be considered to be present in all the down link systems of the plurality of road side equipments, and as a result, the problem of the down link system of the on-vehicle equipment can be detected.

In the event that up link communication from a plurality of the on-vehicle equipments is judged to be abnormal in the road side equipments, it can be determined that the up link system in the road side equipments is abnormal.

In the case where the on-vehicle equipment communicates with a road side equipment, the on-vehicle equipment supplies passage data, which designate roadside equipments from which signals are received to the road side equipment. At this time, the road side equipment compares the passage data with a location of the road side equipments, whereby the link having a defective beacon can be detected.

Furthermore, in the case where the car performs predetermined up link communication with the road side equipment to supply the predetermined information to the road side equipment but the on-vehicle equipment cannot receive the specific information which should be given only to the on-vehicle equipment which has performed the predetermined up link communication, it can be determined that the up link system of the on-vehicle equipment is abnormal.

BRIEF DESCRIPTION OF THE INVENTION

FIG. 5 is an illustrative view showing the degree of a problem or defect.

FIG. 8 shows a data string image in a memory.

DETAILED DESCRIPTION OF THE INVENTION

Figure 1:
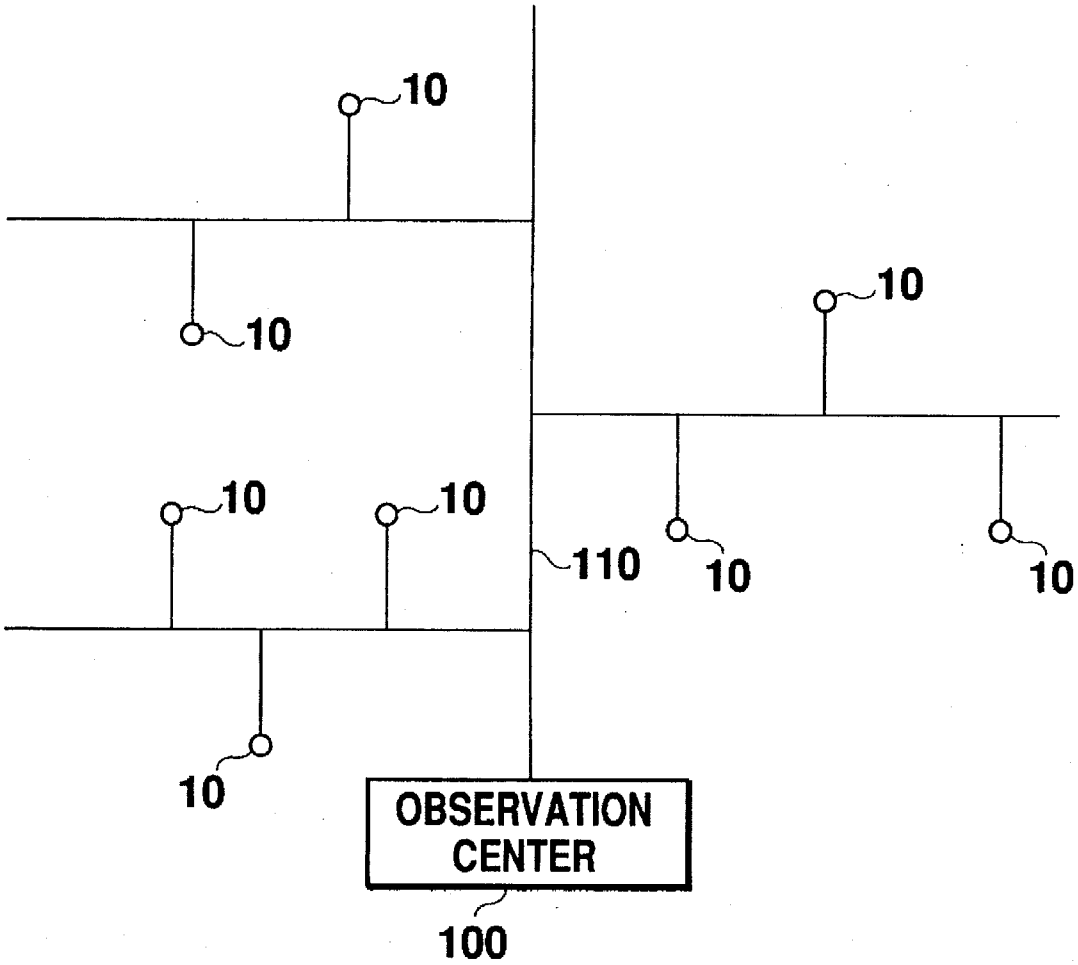
FIG. 1 shows the overall constitution of a road side system of the present invention.
Figure 2:
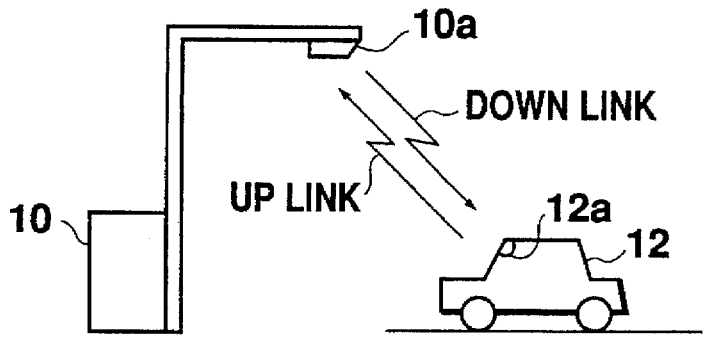
FIG. 2 shows the communication state of a vehicle to roadside communication system of the present invention.

The present invention will be described in detail with reference to an embodiment on the basis of the drawings. FIGS. 1 and 2 show the schematic representation of a vehicle to roadside communication system regarding the present invention. As shown in FIG. 1, many road side equipments 10 are arranged at suitable positions at predetermined intervals along a road. These road side equipments 10 are disposed at appropriate intervals so as to ascertain a road situation all over a predetermined district, and all the road side equipments 10 are connected to an observation center 100 via communication lines. In the observation center 100, the road traffic situation and the like all over the district can be ascertained. Furthermore, the road side equipments 10 can also communicate with each other via the observation center 100, but communication between the road side equipments 10 is limited to communication between neighboring ones.

As shown in FIG. 2, each road side equipment 10 has an optical beacon 10*a*. This optical beacon 10*a* can receive and send a signal by the utilization of pulse-modulated near infrared rays, and it can always irradiate the rays to a car 12 which is being run on a road.

On the other hand, the car 12 has a transmitting/receiving section 12*a* as the on-vehicle equipment at the front upper position thereof in order to perform the communication with the optical beacon 10*a* by the near infrared rays. In this system, it is fundamentally regarded that every car 12*a* which runs in the district has the transmitting/receiving section 12*a*. Therefore, the car 12 which passes under the optical beacon 10*a* decides that the car is within a communication area, when the car runs in the district and the intensity of the received rays becomes a predetermined level or more, and the car 12 performs predetermined communication with the road side equipment 10.

In this way, the road side equipment 10 can ascertain the number of passed cars by communication with the cars. Furthermore, when the road side equipment 10 receives a car ID for specifying the car, the observation center can recognize a time required for the specific car to pass between the road side equipments 10, and the recognized time can be utilized as information for the supposition of the time required to run in the area. When the road side equipments receive the information of a destination, a recommended route to the car destination can be presumed in consideration of a future traffic stream.

Therefore, the traffic situation of the district can be accurately ascertained on the basis of these pieces of information, and thus the proper traffic restriction and supervision of signals, the presentation of optimum route information, and the like can be accomplished. On the other hand, the car can confirm an absolute position (latitude and longitude) of itself when it has passed just under the optical beacon 10*a*, and so the information of the present position of the car can be revised in a navigation device or the like. Furthermore, if the car receives accident information and congestion information from the road side equipments 10, an appropriate route can be selected. Moreover, if sending the destination information to the road side equipments, the car can obtain the information of the optimum route, and afterward the car can experience easy running.

Incidentally, the communication from the road side equipment 10 to the car is called a down link, and the communication from the car 12 to the road side equipment 10 is called an up link.

Figure 3:
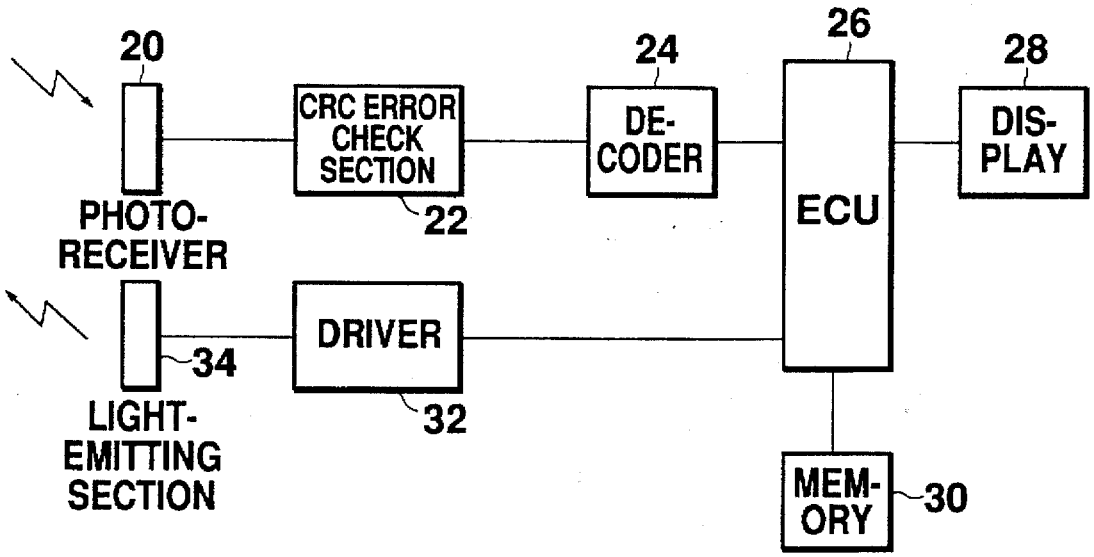
FIG. 3 is a block diagram illustrating the constitution of an on-vehicle equipment.

Next, the constitution of the transmitting/receiving equipment (the on-vehicle equipment) of the car will be described with reference to FIG. 3. In order to receive the communication of the down link, a photoreceiver 20 is disposed, which converts a light signal into an electric signal. The photoreceiver 20 is connected to a CRC error check section 22, decodes which a cyclic redundancy check code (CRC) present in a received signal and checks whether or not an error exists in the received signal. The CRC error check section 22 is connected to a decoder 24, which decodes the received signal to restore usual data, and the thus restored data are supplied to an ECU 26.

The ECU 26 decodes position information, congestion information and the like sent by the down link, and performs predetermined processing. If necessary, a predetermined display is carried out on a display 28, and the necessary data are stored in a memory 30.

On the other hand, the ECU 26 creates data for communication, using the car ID and other necessary data, and sends the created data to a driver 32, which drives a light-emitting section 34 in compliance with the supplied data, and a predetermined light signal is sent from this light-emitting section 34.

Figure 4:
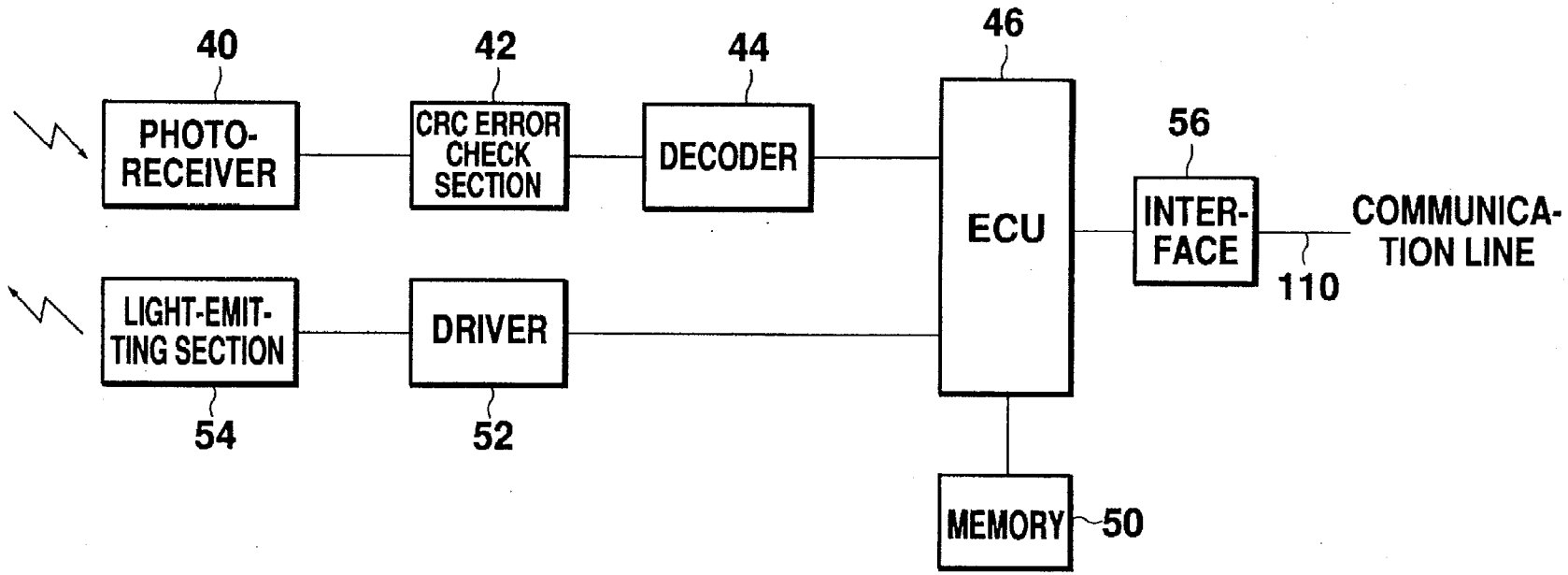
FIG. 4 is a block diagram illustrating the constitution of a road side equipment.

FIG. 4 shows the constitution of the road side equipment 10. As is apparent from this drawing, the constitution of the road side equipment 10 is about the same as in the on-vehicle equipment and comprises a photoreceiver 40, a CRC error check section 42, a decoder 44, an ECU 46, a memory 50, a driver 52 and an emitting section 54. By virtue of these members, the road side equipment performs optical communication with the on-vehicle equipment. The road side equipment 10 is connected to a communication line 110 via an interface 56. Thus, each road side equipment 10 accomplishes two-way communication of information with the observation center 100.

This observation center 100 has a large-scale computer, in which information obtained from the respective road side equipments 10 is collected, statistically processed and analyzed, or a predetermined piece of information is supplied to the respective road side equipments 10.

In the system of the present embodiment, a problem or a defect of the transmitting/receiving equipments on the road side and the on-vehicle can be accurately detected. The problem and the defect can be classified as in FIG. 5. In this drawing, ○ means a normal state, and Δ means that communication is possible to some extent but an error is partially generated in a part of the information owing to corruption and the like. In addition, x means a very abnormal state for which repair is necessary. As is apparent from the foregoing, the state of the up link and the down link can be classified into the normal state, a defective state and the abnormal state, and nine combinations of from case 1 to case 9 can be considered, as shown in FIG. 5. In this embodiment, the problem or defect can be reliably detected in accordance with the above-mentioned classification.

Figure 6:
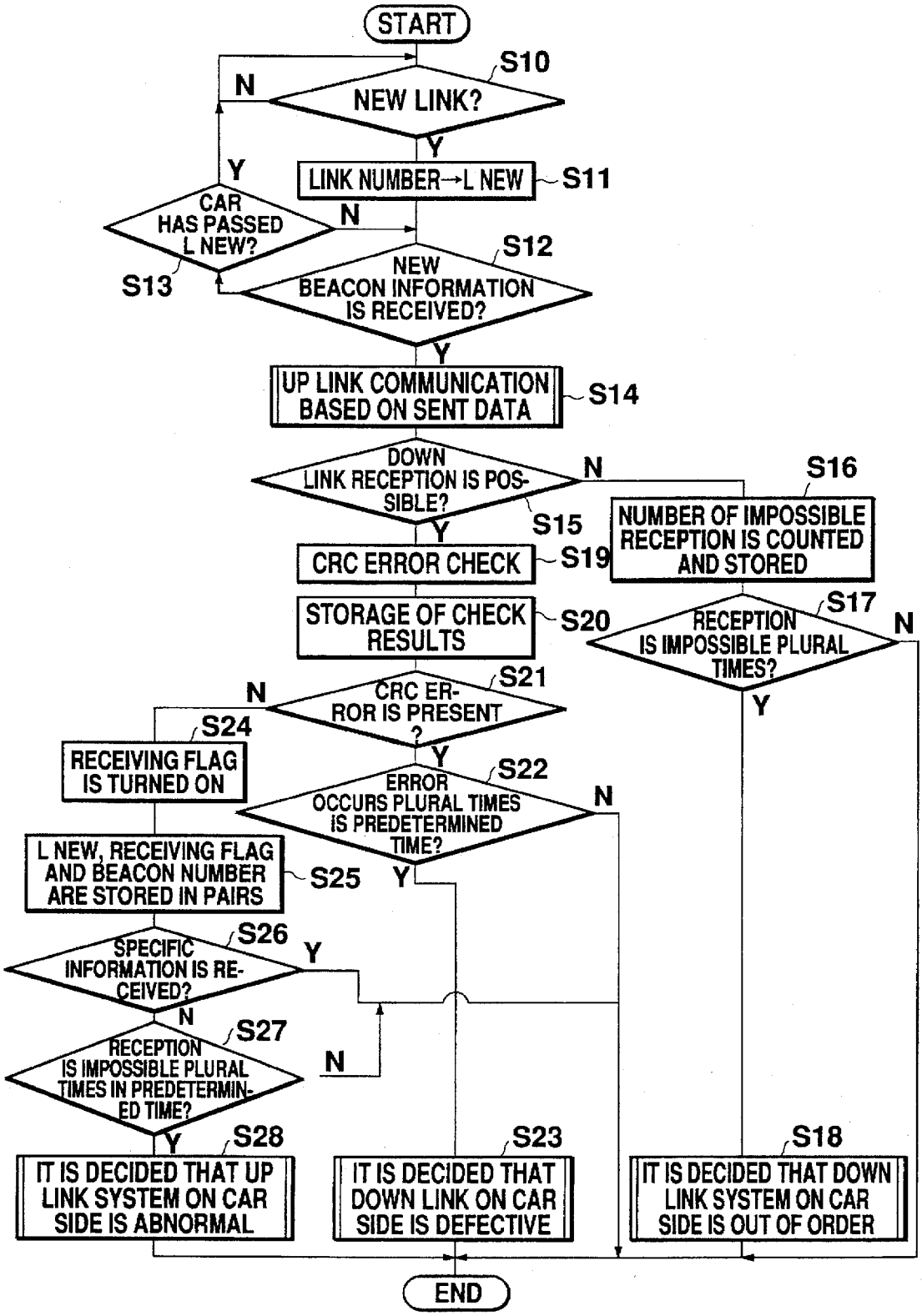
FIG. 6 is a flow chart illustrating the processing sequence of an embodiment.

In the first place, the behavior of the car will be described with reference to FIG. 6. Now, UTMS (new traffic management system) has been suggested as a traffic management system, and in this UTMS, all the roads are divided into links having link numbers. The cars can be classified into two kinds, namely those having a link data base (hereinafter referred to as "link D/B") and those having no link D/B. FIG. 6 illustrates a processing algorithm, assuming that most of the on-vehicle equipments have the link D/B.

In the first place, the on-vehicle equipment decides whether or not the car gets into a new link (S10). The car recognizes its present positionn with the aid of a navigation device carried thereon, and therefore when the car gets into the new link, this fact can be recognized by the on-vehicle equipment. Here, the link means one unit of a passage course recognized by the navigation system. One road is divided into an up road and a down road, and for example, each span between the predetermined intersections of the road is defined as one link, and each number is allotted to the link.

When the car has entered the new link, its link number is input into a variable number L New (S11). Then, it is determined whether or not information from the beacon is received (S12). If the information from the beacon cannot be received, it is determined whether or not the car has passed the link (the link number is L New) (S13). If the car has not passed the link, the processing is returned to S12 and the above-mentioned decision is then repeated. If the information from the beacon cannot be received until the car has passed the link, the processing is returned to S10 and the processing of the new link is then begun.

Figure 7:
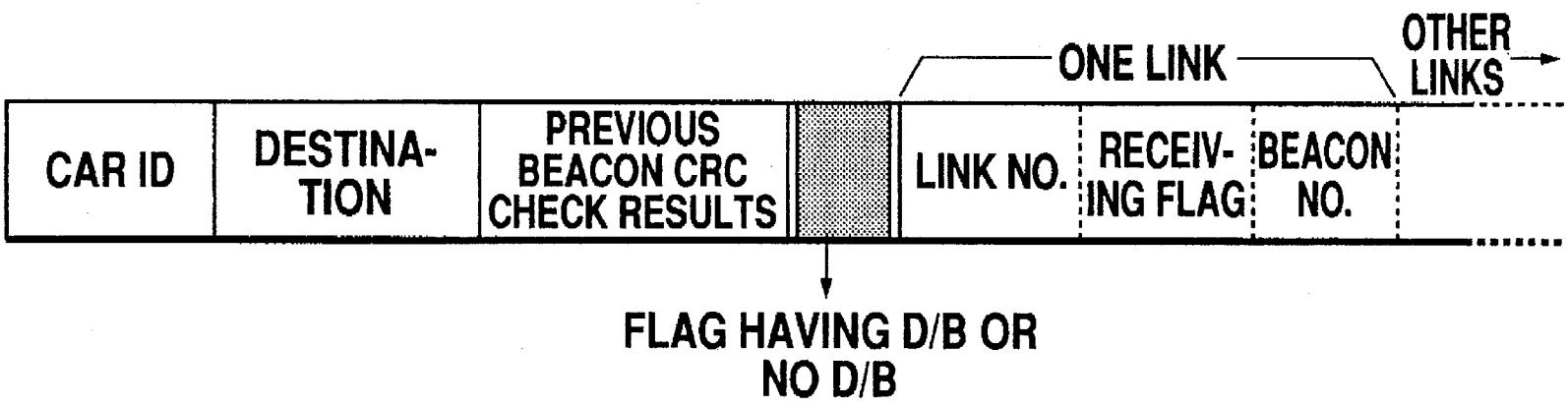
FIG. 7 shows a data format of up link communication.

On the other hand, when the general information from the beacon is received in S12, predetermined light is emitted from the light-emitting section 34 on the basis of transmit data which are stored beforehand in the memory 30, whereby up link communication is performed (S14). A data format at the time of this up link communication is, for example, as shown in FIG. 7. That is to say, the format comprises a car ID, the results of previous beacon CRC check, the flag of the presence/absence of the link D/B, and the data for indicating whether or not the information from the beacons of the plural links which the car has passed is received. In the shown example, the communication of the up link may contain the information of a destination and the like, and in this case, specific (differential) information added to common information can be received by the beacon. In the case that such an up link communication is performed, the communication of the down link is carried out from the road side equipment. Then, it is determined whether or not the down link communication is received within a predetermined time (S15). When it is determined in this S15 that the down link communication is not received, the number of times no reception occurs is counted and stored (S16), and it is further determined that no reception continuously occurs plural times (S17). If the non-reception phenomenon continuously occurs plural times, it is determined that the down link system of the car is out of order (S18). That is to say, it cannot be considered that all of the plural beacons have a problem, and judging from the fact that the data reception of the down link is not performed at all, it can be presumed that any one of the photoreceiver 20 to the ECU 26 in the car is out of order. In this way, the problem or the defect of the case 3 or 6 in FIG. 5 can be determined. Furthermore, among the items of down link information, the common information is receivable irrespective of the presence of the up link information, and therefore the case 9 can be determined by S16 to S18.

Next, when it is determined in S15 that the data of the down link is received, this received data is also subjected to the CRC error check (S19). This CRC error check is performed in the CRC error check section 22. The results of this check are stored in the memory 30 (S20). It is determined whether or not the CRC error is present (S21), and if the CRC error is present, it is determined whether or not the error occurs several times within a predetermined time (S22). If this CRC error occurs several times, it is determined that the down link of the car is defective (Δ) (S23). The reason for this is that the generation of the error in the received data is due to the fact that the problem is present in the down link system from the road side equipment 10 or in the up link system of the car. On the basis of the fact that the CRC error occurs plural times in the received signal, it is determined that the problem is present in the down link system of the car (any one of the cases 2, 5 and 8).

On the other hand, when it is determined in S21 that the CRC error is not present, a receiving flag is turned on (S24), and L New which is the number of the link where the car is being run, the receiving flag and a beacon number are stored in pairs in the memory 30 (S25). That is to say, in the memory 30, there are stored the numbers of the links, the receiving flags and the beacon numbers, as shown in FIG. 8. In this case, as much data are stored in the memory as is previously predetermined, and when the data overflow, the oldest data are discarded in turn and the new data are added thereinto. The number of the data which can be stored in the memory is, for example, in the range of 10 to 20.

On the other hand, in the case that the common information is received, it is next determined whether or not the specific information is received (S26). In this system, only when information of a destination name, the data of another beacon and the like is received by the up link information, is the information of the congestion information and a travel time (a time required to reach the destination) or the like supplied. Thus, in the case that the specific information cannot be received, although the predetermined information is supplied by the up link communication, it is determined that this non-reception phenomenon continuously occurs plural times (S27), and if it continuously occurs plural times, it is determined that the up link is abnormal (S28). That is to say, the fact that the common information can be received means that the down link system has no problem, and the fact that the specific information cannot be received means that a problem is present in the up link system. In consequence, the problem of the case 4 or 7 can be determined.

In this way, according to the processing of the present embodiment, the problem of the up link system and the down link system of the car can be determined.

Figure 9:
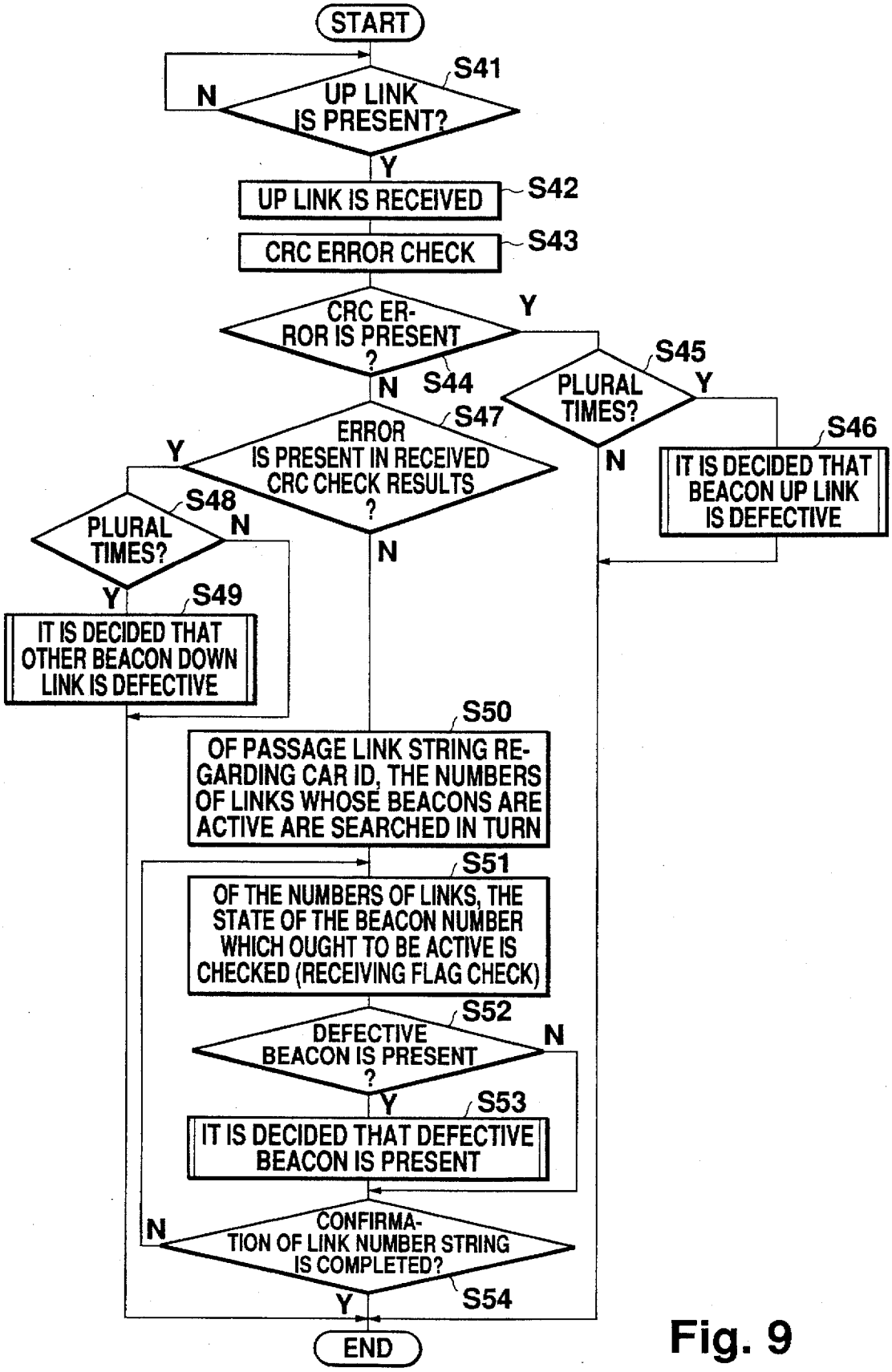
FIG. 9 is a flow chart illustrating a processing sequence in the road side equipment.

Next, processing in the road side equipment 10 will be described with reference to FIG. 9. In the first place, it is determined whether or not the up link communication is established from the on-vehicle equipment (S41), and if the up link communication is established, the processing for receiving it is performed (S42). Then, a CRC error check is performed (S43) for the received data to determine whether or not a CRC error is present (S44). If the CRC error is present, it is determined whether or not the error occurs plural times (S45), and if the error occurs plural times, it is determined that the up link in the road side equipment is defective (S46). That is to say, judging from the fact that the CRC error occurs in the up link communication from a plurality of cars, it can be determined that the error is not in the car but in the reception system in the road side equipment. In consequence, the defect (any one of the cases 4 to 6 in FIG. 5) of the up link system in the road side equipment can be determined.

On the other hand, if it is determined in S44 that the CRC error is not present, it is determined whether or not the error is present in the data of the section called "CRC check results" contained in the received signal. That is to say, it is determined from the data of "previous beacon CRC check results" in the data format shown in FIG. 7 that the error is present in the data from the previous beacon (S47). If it is determined in S47 that the results are erroneous, it is determined that the error occurs plural times (S48), and if the error occurs plural times, it can be determined that the down link of the beacon is defective (S49). That is to say, judging from the fact that the CRC error occurs in the received data in a plurality of cars, it can be considered that the signal itself generated from the beacon contains the error, and it can be presumed that the down link of the beacon is defective. In consequence, the defect (any one of the cases 2, 5 and 8) of the down link system of the road side beacon in FIG. 5 can be determined. Next, if it is determined in S47 that the results contain no error, the numbers of link strings whose beacons are active are searched in turn from the link strings in the data in an information reception state from the car passage links, and the beacons which are received in the up link communication from the cars, referring to the data which the road side equipments beforehand have (S50). Then, of the searched link numbers, the state of the beacon number which ought to be now active is checked (S51). That is to say, it is determined whether or not the receiving flag of the up link data is 1, whereby it is determined whether or not the reception is actually accomplished. If the reception from the beacon which ought to be now active is not accomplished, it can be presumed that this beacon is out of order, and so it is determined whether or not the defective beacon is present (S52). Then, if the defective beacon is present, this is determined (S53). In this way, the problem of the other beacon is determined by the information of the up link communication obtained from the car. In consequence, the problem of the down link system of any one of the cases 3, 6 and 9 in FIG. 5 can be determined.

Next, it is determined whether or not the confirmation of all the link strings has been completed (S54), and if it has not been completed yet, the processing is returned to S51 and the check is repeated. As is apparent from the foregoing, in the present embodiment, the defect of the up link system in the road side equipment is determined by the CRC error check, and the defect of the down link system or any problem of the down link system in the other beacon can be determined by the information from the car. In this processing, the detection of a problem in the up link system is impossible, but a problem of the up link system is detectable owing to a situation where the up link information cannot be received at all, or the like.

When a defect in the up link communication from the specific car is detected in a plurality of road side equipments, it can be recognized that the up link system of the car is defective. Thus, it may be reported from the predetermined road side equipment to the car that the up link is defective, whereby the car may be caused to recognize the defect of the up link system of the on-vehicle equipment.

Figure 10:
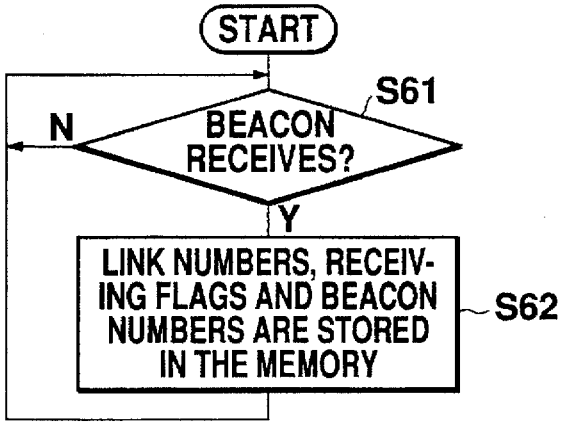
FIG. 10 is a flow chart illustrating a processing sequence in the on-vehicle equipment in the case that a link D/B is not present.

Next, reference will be made to a diagnostic method in the case that many cars not having a UTMS link data base (D/B) are present. In this case, processing in the car is performed as follows. In the first place, as shown in FIG. 10, it is determined whether or not the reception in the beacon is performed (S61), and if the reception is carried out, link numbers, receiving flags and beacon numbers are stored in the memory 30 (S62). Therefore, about the same amount of data as in FIG. 8 are stored in the memory 30. In this case, however, each receiving flag is always 1, and the link numbers, beacon numbers and the like, regarding data which cannot be received, are not stored. Furthermore, the decision and the like of the CRC error check, the reception of the common information, the reception of the specific information, and the like, are the same as described above.

Figure 11:
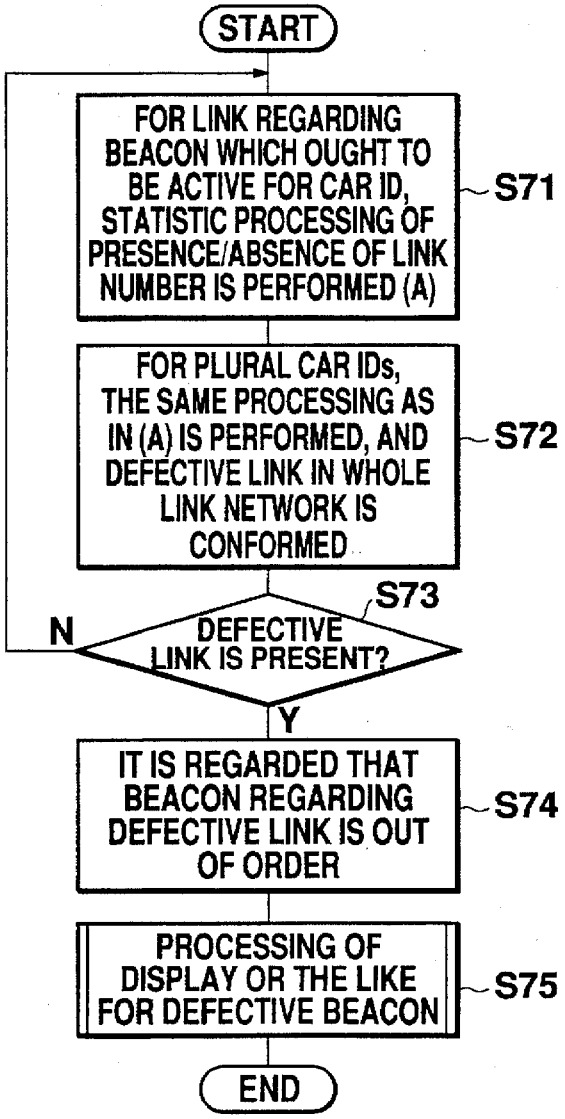
FIG. 11 is a flow chart illustrating a processing sequence in the road side equipment in the case that the link D/B is not present.

On the other hand, the processing of the road side equipment in this case is performed as follows. As shown in FIG. 11, the course of the car is first presumed on the basis of the up link information from the car, and it is determined whether or not a defective link in one of the beacons along the route is detected (S71). Next, the data from a plurality of cars are also similarly processed to obtain such processing results. Then, the link (defective link) which is not detected is confirmed by the results of this processing, though a plurality of cars pass the links (S72). If it is not determined whether or not the defective link is present, the processing is returned to S71. On the other hand, if the defective link is present, it can be presumed that the beacon regarding this defective link is defective (S74), and the processing of this defective beacon is performed (S75). The processing in this road side equipment corresponds to the processing of S50 to S53 in FIG. 9.

As is apparent from the foregoing, also for the cars having no link D/B, the defect of the beacon or the on-vehicle equipment can be detected as in the above-mentioned embodiment.

Figure 12:
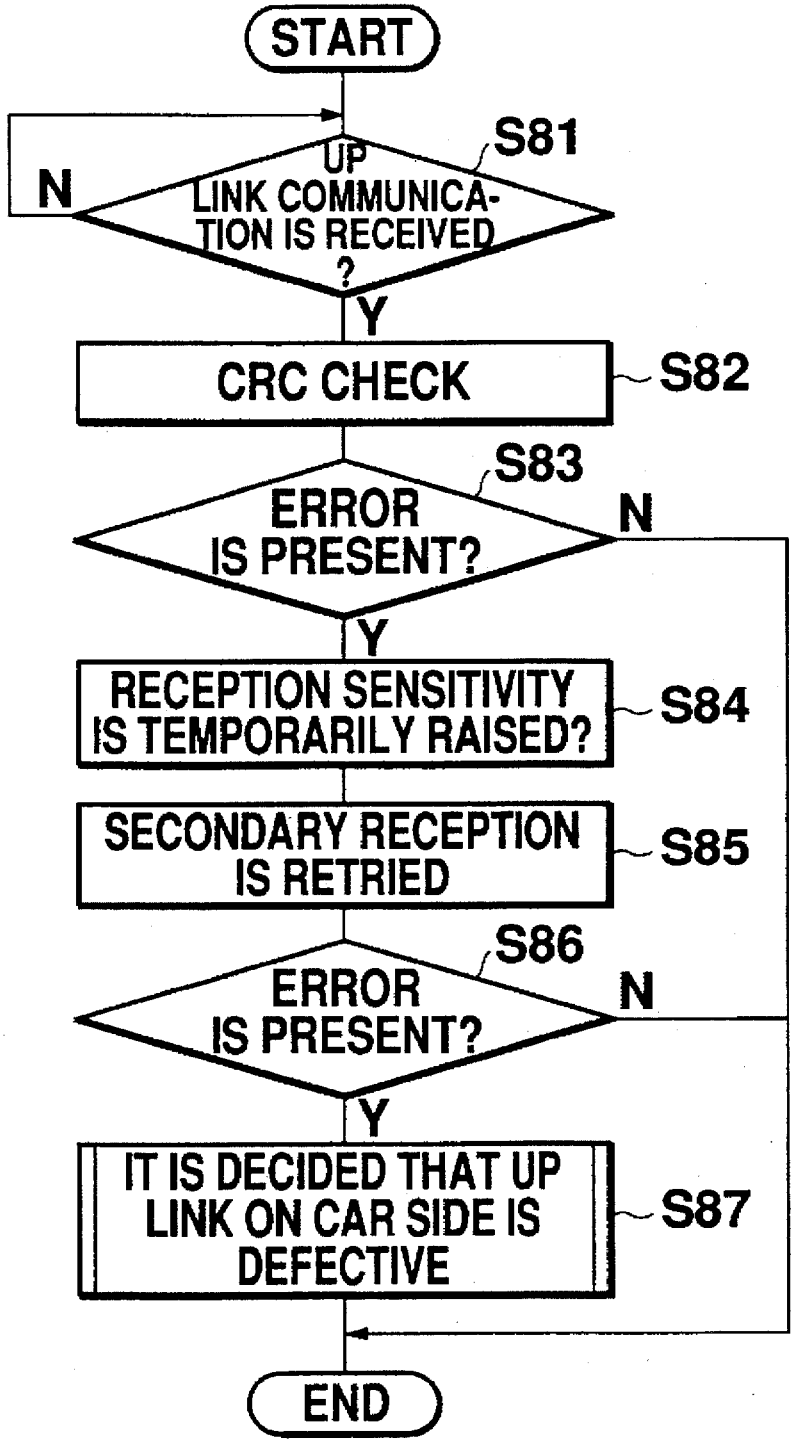
FIG. 12 is a flow chart illustrating a processing sequence in which a defect of an on-vehicle up link system is detected in the road side equipment.

Next, referring to FIG. 12, reference will be made to an embodiment in which a control section for reception sensitivity is disposed in the up link abnormal determining section of the road side equipment and the defect of the up link system of the car is determined in the road side equipment. In the first place, it is determined whether or not the up link communication from the car is received in the road side equipment (S81), and if it is received, the CRC check is performed (S82). Next, it is determined whether or not the error is present (S83), and if the error is present, the reception sensitivity is temporarily raised (S84), and the secondary reception is retried (S85). After the retried reception, the similar check is performed to determine whether or not the error is present (S86), and if the error is present, it can be determined that the up link system of the car is defective (S87). In this way, when the problem of the up link system on the side of the car is detected in the road side equipment, this is reported to the car using, for example, a display.

When the up link communication from the on-vehicle equipment to the road side equipment 10 is performed, it is determined in the road side equipment 10 whether or not an up link problem is present in this up link communication. If a problem is present, this fact is reported to the observation center 100, and when a problem of the up link system in the specific on-vehicle equipment is confirmed in a plurality of the different road side equipments 10, the observation center 100 determines that the up link system of the on-vehicle equipment is abnormal, and an up link system problem of the on-vehicle equipment can be detected. In this case, a camera or the like is suitably used to specify the car.

What is claimed is:

1. A vehicle to roadside communication system, for performing vehicle to roadside communication between a plurality of road side equipments arranged on a road and a plurality of on-vehicle equipments carried on a plurality of cars, comprising:

a down link system problem determining section carried on the car for determining the presence/absence of a down link problem in down link communication in the on-vehicle equipment, when the down link communication from the road side equipment to the on-vehicle equipment is performed, a down link problem reporting section for reporting, to at least one of the road side equipments, the information regarding the down link problem for specifying the road side equipment by which the abnormal down link communication has been performed, in the case that the down link problem has been detected by the down link system problem determining section carried on the car, and a road side down link problem determining section for determining the down link problem of the specific road side equipment, in the case that the information regarding the down link problem of the specific road side equipment is received plural times in one road side equipment, whereby the down link problem in the road side equipment is determined.

2. The vehicle to roadside communication system according to claim 1 wherein a plurality of the road side equipments are connected to an observation center via a communication line, whereby the information regarding the other road side equipment judged to be abnormal is reported to the observation center.

3. A vehicle to roadside communication equipment, carried on a vehicle, for performing vehicle to roadside communication with a plurality of road side equipments arranged on a road, comprising:

a down link system problem determining section, carried on the car, for determining the presence/absence of a down link problem in down link communication, when the down link communication from the road side equipment is performed, and a road side down link problem determining section for determining that the down link is abnormal, when the down link problem is detected in the down link communication from a plurality of the road side equipments by the down link system problem determining section, wherein the down link problem is determined to be an on-vehicle down link problem or a road side equipment down link problem.

4. A vehicle to roadside communication equipment, carried on a vehicle, for performing vehicle roadside communication with a plurality, of road equipment arranged along a road, comprising:

a down link system problem determining section, carried on the car, for determining the presence/absence of a down link problem in down link communication, when the down link communication from the road side equipment is performed; and a road side down link problem determining section for determining that the down link is abnormal when the down link problem is detected in the down link communication from a plurality of the road side equipments by the down link system problem determining section, wherein the down link problem is judged to be an on-vehicle down link problem, in the case that data cannot be received, and the down link problem is judged to be an on-vehicle down link defect, in the case that an error is present in the data.

5. The vehicle to roadside communication equipment according to claim 4 wherein when the down link problem is detected this problem is displayed on a display.

6. A vehicle to roadside communication system, for performing vehicle to roadside communication between a plurality of road side equipments arranged on a road and a plurality of on-vehicle equipments carried on a plurality of vehicles, comprising:

an up link system problem determining section for determining, in the road side equipment, the presence/absence of an up link problem in up link communication, when the up link communication from the on-vehicle equipment to the road side equipment is performed, and a road side up link problem determining section for determining the up link of the road side equipment is abnormal, when the up link problem is detected in the up link communication from a plurality of on-vehicle equipments by the up link system problem determining section, whereby the up link problem in the road side equipment is determined.

7. The vehicle to roadside communication system according to claim 6 wherein a plurality of the road side equipments are connected to an observation center via a communication line, whereby the information regarding the other road side equipment judged to be abnormal is reported to the observation center.

8. A vehicle to roadside communication system, for performing vehicle to roadside communication between a plurality of road side equipments arranged along a road and a plurality of on-vehicle equipments carried on a plurality of cars, comprising a road side equipments memory section, disposed on the on-vehicle equipment, for memorizing passage data designating the road side equipments from which signals were received, a passage data communication section, disposed on the on-vehicle equipment, for performing the up link communication of the passage data to the road side equipment, and a road side down link problem determining section, disposed on the road side equipment, for determining a down link problem of the other road side equipment by checking the received passage data with the information regarding the disposition state of the other road side equipment which the road side equipment has, whereby the down link problem in the road side equipment is determined.

9. The vehicle to roadside communication system according to claim 8 wherein a plurality of the road side equipments are connected to an observation center via a communication line, whereby the information regarding the other road side equipment judged to be abnormal is reported to the observation center.

10. A vehicle to roadside communication system, for performing vehicle to roadside communication between a plurality of road side equipments arranged along a road and a plurality of on-vehicle equipments carried on a plurality of cars, comprising:

a specific information down link section, disposed on each of the plurality of road side equipments, for performing the down link transmission of specific information to the plurality of on-vehicle equipments, and an on-vehicle up link problem determining section, disposed on each of the on-vehicle equipments, for determining that an up link system is abnormal, when the specific information is not obtained from a plurality of roadside equipments though the up link information is supplied, whereby the up link problem in the plurality of on-vehicle equipments is determined.

11. A vehicle to roadside communication equipment, carried on a car, for performing vehicle to roadside communication with a plurality of road side equipments arranged along a road, comprising:

an on-vehicle up link communication section for supplying up link information to the plurality of road side equipments requesting the supply of specific information, and an on-vehicle up link problem determining section for determining that an up link system is abnormal, when the specific information is not obtained from the plurality of road side equipments though the up link information is supplied, whereby file up link problem in the on-vehicle equipment is determined.

12. A vehicle to roadside communication equipment, carried on a car, for performing vehicle to roadside communication with road side equipments arranged along a road, comprising:

an on-vehicle up link communication section for supplying up link information requesting the supply of specific information from the road side equipment, and an on-vehicle up link problem determining section for determining that an up link system is abnormal, when the specific information is not obtained from a plurality of roadside equipments though the up link information is supplied, whereby the up link problem in the on-vehicle equipment is determined and wherein when the up link problem is detected, this problem is displayed on a display.

* * * * *

UNITED STATES PATENT AND TRADEMARK OFFICE

CERTIFICATE OF CORRECTION

PATENT NO. : 5,666,109

DATED : 9 September 1997

INVENTOR(S) : Mitsuhiro FUKUI et al.

It is certified that error appears in the above-identified patent and that said Letters Patent is hereby corrected as shown below:

| Column | Line | |
|---|---|---|
| 2 | 66 | After "defect." start new paragraph. |
| 5 | 16 | Change "positionn" to --position--. |
| 9 | 50 | Change "vehicle roadside" to --vehicle to roadside--. |
| 9 | 51 | Change "plurality, of road equipment" to --plurality of road side equipments--. |
| 9 | 57 | After "performed" change ";" to --,--. |
| 12 | 1 | Change "file" to --the--. |

Signed and Sealed this

Third Day of March, 1998

Bruce Lehman

*Attest:*

BRUCE LEHMAN

*Attesting Officer*

*Commissioner of Patents and Trademarks*